US007306398B2

(12) United States Patent
Doran, Jr.

(10) Patent No.: US 7,306,398 B2
(45) Date of Patent: Dec. 11, 2007

(54) HIGHWAY MARKER TRANSFER VEHICLE

(76) Inventor: John Terrence Doran, Jr., 1336 Jordan Dr., Shadyside, MD (US) 20764

( * ) Notice: Subject to any disclaimer, the term of this patent is extended or adjusted under 35 U.S.C. 154(b) by 197 days.

(21) Appl. No.: 11/029,468

(22) Filed: Jan. 6, 2005

(65) Prior Publication Data

US 2006/0147264 A1 Jul. 6, 2006

(51) Int. Cl.
*G07F 11/50* (2006.01)
*B60P 1/00* (2006.01)

(52) U.S. Cl. ..... 404/84.05; 221/186; 414/551

(58) Field of Classification Search ..... 404/73, 404/9, 84.05; 414/551; 221/185, 186
See application file for complete search history.

(56) References Cited

U.S. PATENT DOCUMENTS

| | | | | |
|---|---|---|---|---|
| 3,157,267 | A | 11/1964 | Asbury | |
| 3,232,408 | A * | 2/1966 | Asbury | 198/617 |
| 3,268,052 | A | 8/1966 | Asbury | |
| 3,348,732 | A * | 10/1967 | Schwarz | 221/123 |
| 3,626,804 | A | 12/1971 | Paramythioti | |
| 3,750,900 | A | 8/1973 | Piercey | |
| 3,762,582 | A * | 10/1973 | Barnhart et al. | 414/787 |
| 4,007,926 | A * | 2/1977 | Ottaway | 472/29 |
| 4,262,831 | A * | 4/1981 | Buchanan | 224/565 |
| 4,597,706 | A | 7/1986 | Michit | |
| 4,747,515 | A | 5/1988 | Kasher | |
| 4,936,485 | A | 6/1990 | Downing | |
| 5,047,107 | A * | 9/1991 | Keller et al. | 156/184 |
| 5,054,648 | A | 10/1991 | Luoma | |
| 5,195,453 | A * | 3/1993 | McGibbon, II | 116/63 C |
| 5,213,464 | A | 5/1993 | Nicholson et al. | |
| 5,244,334 | A | 9/1993 | Akita et al. | |
| 5,525,021 | A | 6/1996 | Larguier | |
| 5,607,221 | A * | 3/1997 | Justus | 362/485 |
| 6,056,498 | A | 5/2000 | Velinsky et al. | |
| 6,158,948 | A | 12/2000 | Calvert | |
| 6,435,369 | B1 | 8/2002 | Poursayadi | |
| 6,615,881 | B2 * | 9/2003 | Bartholomew et al. | 141/18 |
| 6,726,434 | B2 | 4/2004 | Orthaus et al. | |
| 6,752,582 | B2 | 6/2004 | Garcia | |
| 2002/0113873 | A1 * | 8/2002 | Williams | 348/118 |
| 2004/0057822 | A1 | 3/2004 | Orthaus et al. | |

FOREIGN PATENT DOCUMENTS

| | | |
|---|---|---|
| FR | 2832434 A1 | 5/2003 |
| GB | 2309244 A | 7/1997 |

* cited by examiner

*Primary Examiner*—Raymond W Addie

(57) ABSTRACT

A wheeled vehicle, preferably a trailer, carries highway markers in a storage frame that is horizontally rotated to selectively align each of a plurality of parallel, circularly spaced, slide bearings, each configured to confine a linear array of highway markers against circumferential and radial movement, while allowing sliding along the length of the array. A powered abutment feeds the highway markers to a transfer station. A transfer mechanism picks up a highway marker by attraction and moves it between the transfer station and a highway station. A video camera records the highway station environment and wirelessly sends a video stream to a monitor plugged in the driver's cab. A releasable electrical connector between a tow vehicle and a trailer wheeled vehicle transmits a lights-on signal to control the operations. Power for the attraction, the transfer mechanism, the powered abutment, the camera, the retrieval attachment and a powered index mechanism for the storage frame are provided from a power supply on the trailer.

31 Claims, 10 Drawing Sheets

Figure 3
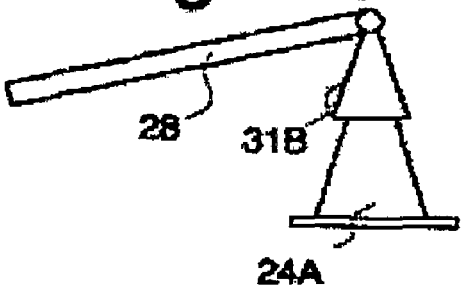
Figure 3A
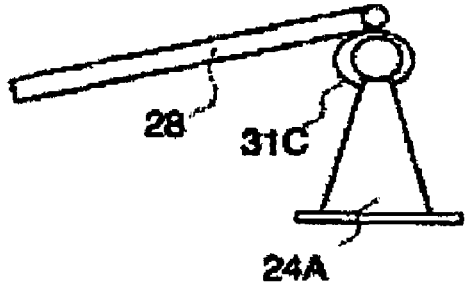
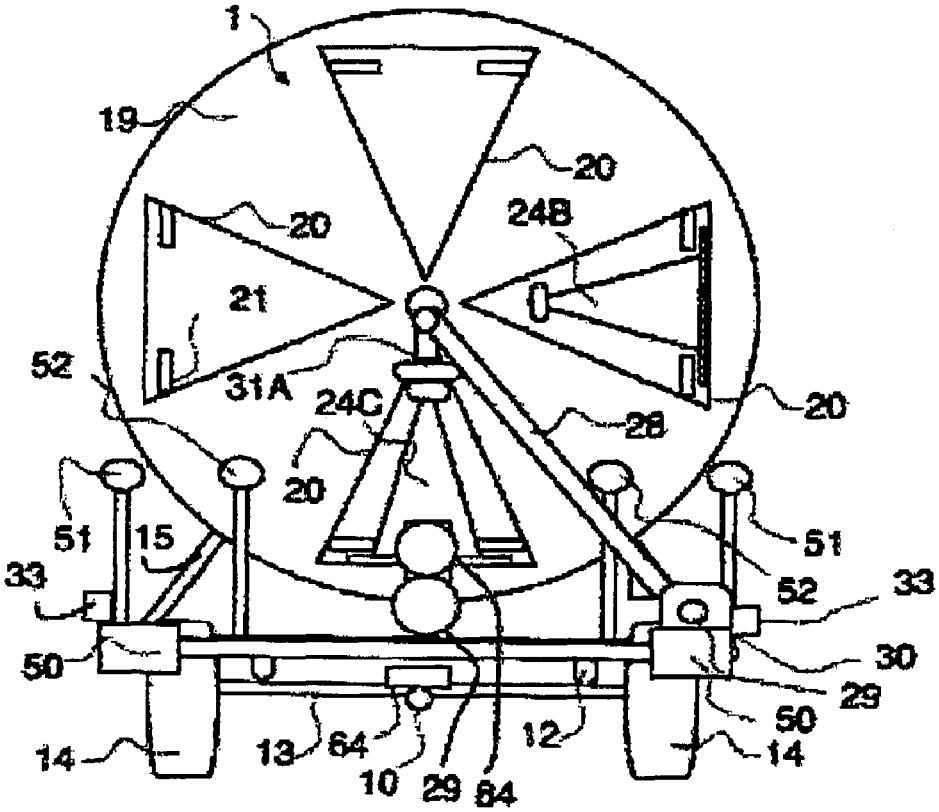
Figure 2

Figure 11
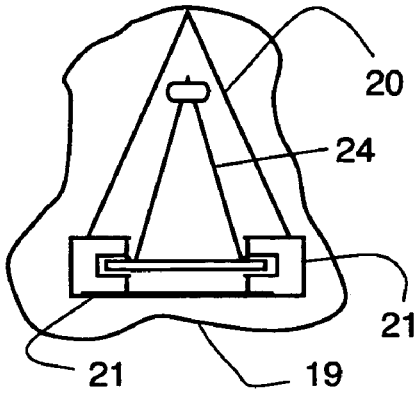
Figure 9
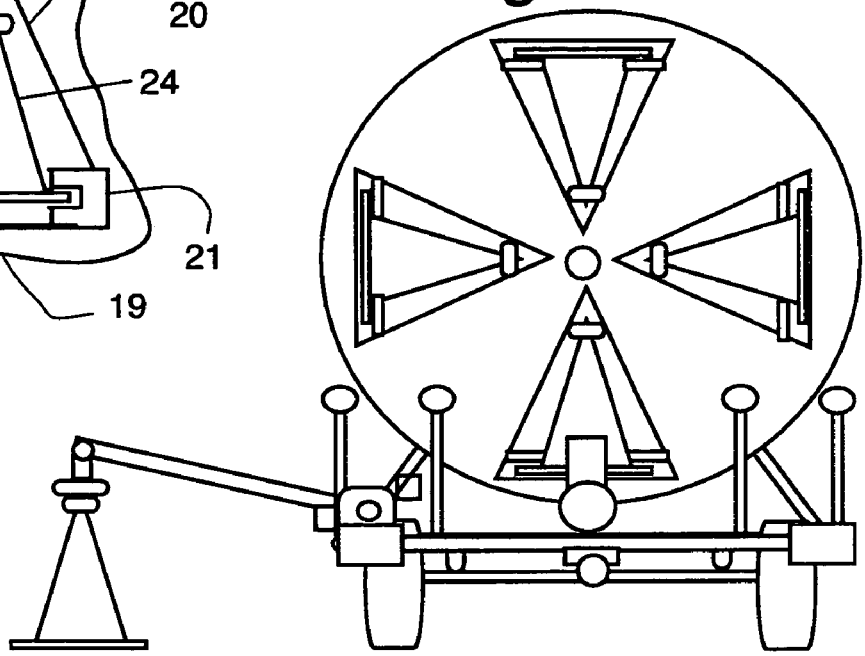
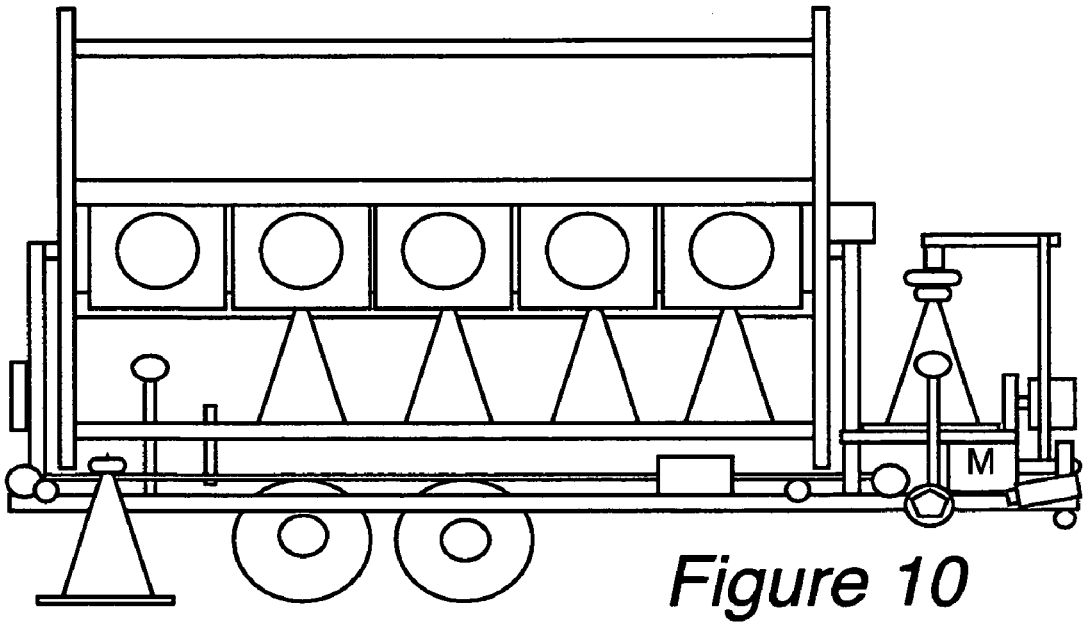
Figure 10

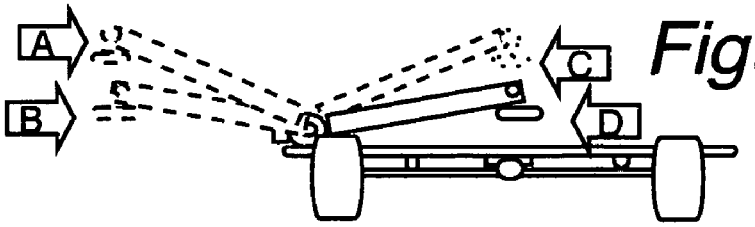
Figure 19
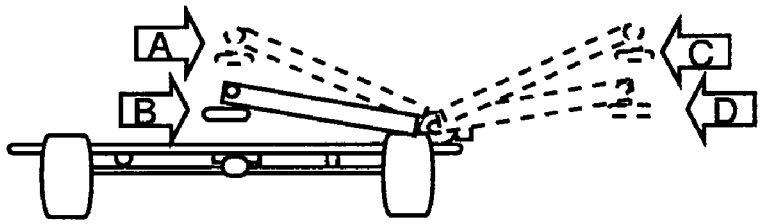
Figure 20
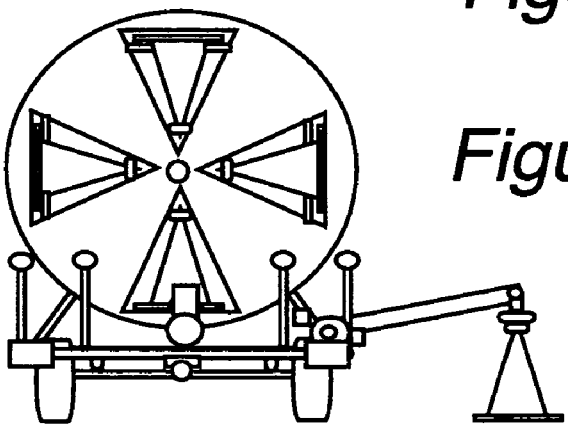
Figure 14
Figure 16
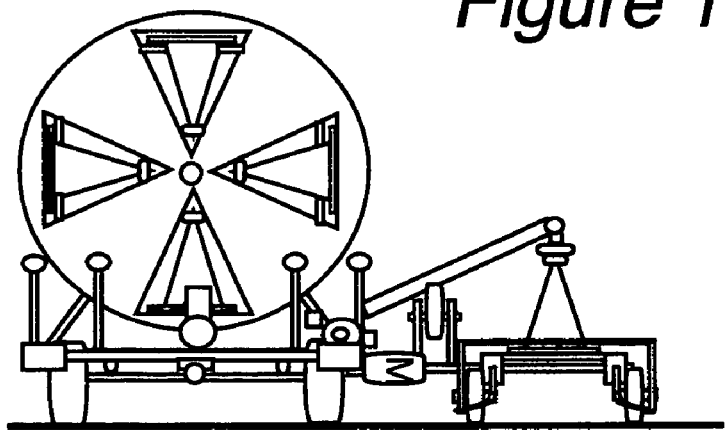

HIGHWAY MARKER TRANSFER VEHICLE

FIELD OF THE INVENTION

The present invention relates to the transfer of highway safety markers between a storage vehicle and the highway, for both lay down and retrieval modes of operation.

BACKGROUND OF THE INVENTION

There is a recognized need for devices to lay down and retrieve highway markers, as exhibited by the numerous patents directed to the subject. However, it is not known if any are actually in use, and if they are in use, the usage appears quite limited.

In practice, three people are needed to lay down and also to retrieve the highway markers. One person drives a truck, a second person stacks or unstacks the highway markers one at a time and hands/receives them relative to a third person who leans out in the path of traffic and sets/grabs them on the highway. This exposes one or more of the people to the dangers of traffic and results in a high labor cost. Some of the above-mentioned patents involve devices that do eliminate one or two workers, however, they appear to suffer in one or more of high complexity, high cost, low capacity, large size and difficulty of storing or retrieving highway markers.

SUMMARY OF THE INVENTION

These and other needs are addressed by the present invention.

The present inventors have analyzed the above-mentioned problems, identified and analyzed causes of the problems, and provided solutions to the problems. This analysis of the problems, the identification and analysis of the causes, and the provision of solutions are each parts of the present invention and will be set forth below.

As a result of analyzing the prior art, the inventor has found a need for a more reliable, lower cost and more fully automated highway marker storage and transfer vehicle.

Therefore, the present invention analysis of the prior art system as to its problems and their causes has led to the need for and the solution of a more effective system.

Among the objects of the invention are to provide a wheeled vehicle for retrieval and lay down of highway markers that is: simple in construction and operation to thereby be reliable and of low initial cost and maintenance; adaptable to pickup highway markers that have been moved from a normal location or orientation; a trailer operable from a tow vehicle without modification of the tow vehicle beyond a standard hitch and standard electrical hookup for trailer lights; operable by one person, a driver, who does not need to leave the driver's position; and of high storage capacity without the complications of nested highway markers, excessive height or excessive footprint.

One or more of the objects are achieved by the embodiment features, which include the following. A wheeled vehicle, preferably a trailer, carries highway markers in a storage frame that is horizontally rotated to be selectively aligned with each of a plurality of parallel, circularly spaced, slide bearings, each slide bearing being configured to confine a linear array of the highway markers against circumferential and radial movement, while allowing sliding along the length of the array. A powered abutment feeds the highway markers to a transfer station. Another powered abutment moves a highway marker away from the transfer station. A transfer mechanism picks up a highway marker by attraction and moves it between the transfer station and a highway station. An optional video camera records the transfer station and highway station environments and then (preferably wirelessly) sends a video stream to a portable monitor plugged into an outlet in the driver's cab. A releasable connector transmits a lights-on signal from the driver's cab to control the retrieval and lay down of a highway marker. The transfer mechanism, the powered abutment, the camera and a mechanism to rotate the storage frame are provided with power from a power supply on the preferred trailer.

Still other aspects, features, and advantages of the present invention are readily apparent from the following detailed description, simply by illustrating a number of particular embodiments and implementations, including the best mode contemplated by the inventor for carrying out the present invention. The present invention is also capable of other and different embodiments, and its several details can be modified in various obvious respects, all without departing from the spirit and scope of the present invention. Accordingly, the drawing and description are to be regarded as illustrative in nature, and not as restrictive.

BRIEF DESCRIPTION OF THE DRAWINGS

The present invention is illustrated by way of a preferred embodiment, best mode and example, but not defined by way of limitation. Further objects, features and advantages of the present invention will become more clear from the following detailed description of a preferred embodiment and best mode of implementing the invention, as shown in the figures of the accompanying drawing, in which like reference numerals refer to similar elements, wherein:

FIG. 2 is a front view of the wheeled vehicle of FIG. 1, with the pickup and transfer mechanism at the transfer station;

FIG. 3 illustrates a front view of another embodiment of the pickup, with part of the transfer mechanism, at the highway station;

FIG. 3A illustrates a front view of another embodiment of the pickup, with part of the transfer mechanism, at the highway station;

FIG. 9 is a front view of the wheeled vehicle of FIG. 1, with the pickup and transfer mechanism on the right side and at the highway station;

FIG. 10 illustrates a right side view of the wheeled vehicle of FIG. 1;

FIG. 11 is a rear view of a broken out portion of the storage frame and slide bearing construction, which is preferably identical to the corresponding front view;

FIG. 14 is a front view of the wheeled vehicle of either 12 or 13, without the truck or cab respectively, showing lay down of a highway marker on the left side;

FIG. 16 is a front view of the wheeled vehicle of either FIG. 12 or 13, without the truck or cab respectively, with the transfer mechanism on the left side at the highway station and with the attachment of FIG. 5 holding a highway marker upright;

FIG. 19 is a schematic view of the four limits of movement of the pickup in when it is at one side of the vehicle; and FIG. 20 is a schematic view of the four limits of movement of the pickup when it is at the other side of the vehicle.

DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement. In other instances, well-known structures and devices are shown in block diagram form in order to avoid unnecessarily obscuring the present invention.

The present inventors have analyzed problems, identified and analyzed causes of the problems, and provided solutions to the problems. This analysis of the problems, the identification and analysis of the causes, and the provision of solutions are each parts of the present invention.

The preferred embodiment satisfies the above-mentioned needs by solving the mentioned problems.

Figure 1:
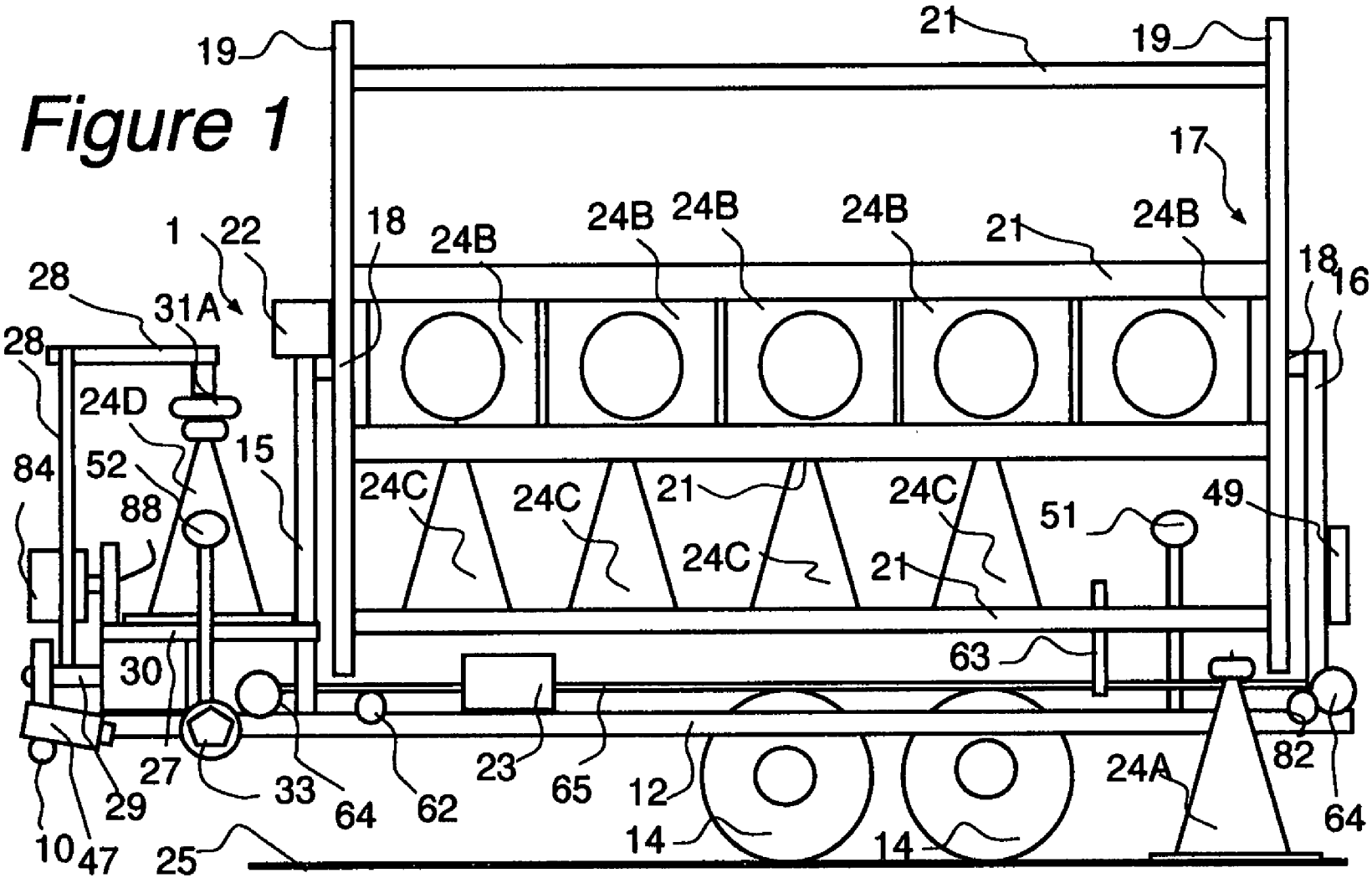
FIG. 1 illustrates a left side view of a wheeled vehicle, preferably a trailer, as an exemplary embodiment of the present invention.
Figure 13:
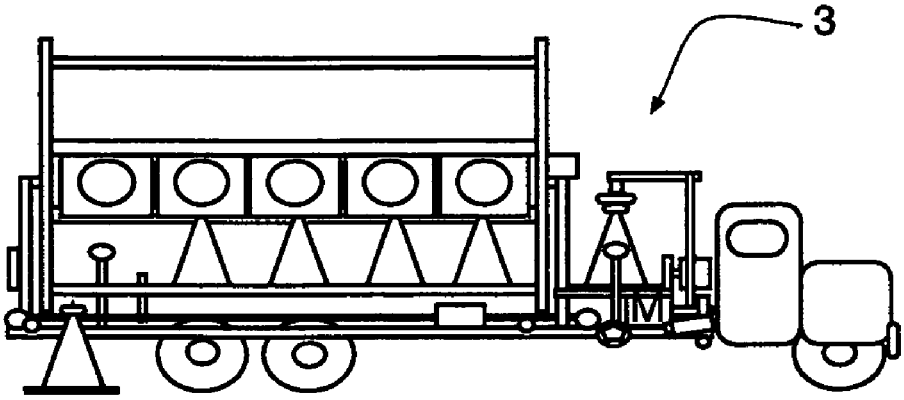
FIG. 13 is a right side view of another embodiment of the wheeled vehicle as a self powered vehicle, with the construction of everything to the rear of the operator's cab being identical to the trailer of FIG. 10 without the tow hitch.
Figure 12:
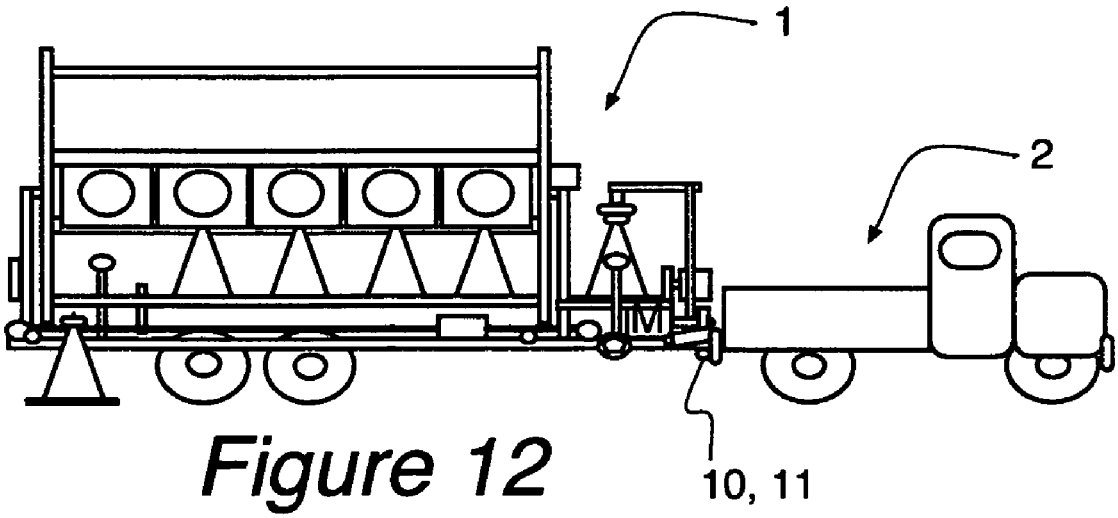
FIG. 12 is a right side view of the trailer as in FIG. 10, on a reduced scale, which trailer is connected for towing by and operation from the driver's cab of a conventional tow vehicle, for example a pickup truck.

The wheeled vehicle, shown in FIG. 1, for transporting highway markers and for exchanging the highway markers between the wheeled vehicle and a highway, is most preferably a trailer 1 having a standard hitch 10 to be coupled to a complimentary hitch 11 on a tow vehicle 2, for example a standard pickup truck as shown in FIG. 12. Alternatively, as another embodiment, the trailer and tow vehicle may be combined as a self powered vehicle, or truck, 3 as shown in FIG. 13. The structural details of the trailer of FIG. 1 are applicable to corresponding structure of the self-powered wheeled vehicle of FIG. 13 and therefore will be set forth in detail only with respect to the trailer example. However, there are considerable advantages to the preferred trailer embodiment of FIG. 12 over the self-powered wheeled vehicle of FIG. 13.

The wheeled vehicle 1 has a main frame 12 supported on one or more axles 13 (FIG. 2), each having one or more wheels 14, the details of which are not significant to the present invention. At the front and rear of the wheeled vehicle 1, respectively to the left and right in FIG. 1, upstanding parts 15 and 16 of the frame 12 support a storage frame 17 on bearings 18 for rotation of the storage frame 17 relative to the main frame 12 about a generally horizontal axis. The axis will vary from true horizontal depending upon hilly or flat highways being traversed, the height of the tow vehicle hitch 11, tolerances of manufacturing, design and the like, but is most preferably close to being horizontal when on a horizontal highway to minimize the vehicle height, which in turn maximizes the storage capacity for a chosen length. Preferably the variation of the axis of rotation from horizontal will be less than ten degrees from true horizontal, but at least less than forty-five degrees. The length of the storage frame 17 is preferably greater than the overall height of the wheeled vehicle 1 above the highway 25, that is, greater than the vehicle clearance.

The storage frame 17 includes front and rear end sub-frames 19 (for larger vehicles, center and other mid frames may be included), each of which is preferably cut as shown in FIG. 2 from a single sheet of steel to have a circular outer perimeter and a plurality of openings 20, preferably generally the configuration of the highway markers in elevation, for example triangular as shown for exemplary cone shaped highway markers 24. While four openings 20 have been illustrated it is most preferable to increase the number to maximize the storage capacity. For example, ten openings 20 may be accommodated in each of the sub-frames 19, arranged equally spaced from each other and the axis of rotation, for a vehicle of approximately the current maximum highway width and currently standard highway marker cones.

As shown more clearly in FIG. 11, at the base of each triangular opening 20, a rail 21 (preferably a steel C-shaped channel) is secured, e.g. welded, to each corner to extend generally horizontally between the sub-frames 19. The outer race of each of the bearings 18 is secured, preferably welded or bolted, to the center of the sub-frames 19, respectively, and the inner race of each of the bearings 18 is secured to the upstanding parts 15 and 16 of the frame 12. An indexing motor 22 is one example of a mechanism that may be used to selectively rotate the storage frame 17 accurately to each of a number of rotational positions. The positions are equal in number to the number of pairs of rails 21, which positions are four in FIGS. 1 and 2; alternatively, a motor and limit switches or stops or an overload sensor may be used for the indexing control of the motor 22. Thereby, the motor 22 indexes (the number of indexing steps corresponding to the number of rotational positions, four being illustrated) the storage frame 17.

The details of the power to drive the mechanical mechanisms are not important to the invention as a whole. For example motors referred to herein may be electric, hydraulic or pneumatic, may rotate, translate or pivot, and include gearing or other transmissions. Further, the controls for such motors may determine positions by stepping or indexing features built into the motors, rigid and adjustable stops combined with motor overload sensors, limit switches, electric eyes or photocells. These controls will determine operation of highway marker handling mechanisms and held highway marker positions.

As shown in FIGS. 1, 2 and 11, each pair of the opposed rails 21 constitutes an example of a slide bearing to confine and guide an array of highway markers 24. For this purpose, the webs of the two opposed rails 21 that make up a slide bearing are spaced apart a distance greater than the corresponding dimension of a lower flange, or other gripping structure, of the highway markers 24, and the legs of each rail 21 are spaced apart a distance greater than the thickness of the flange, or other gripping structure, of the highway markers 24. Each pair of the rails 21 has the inner edges of its opposed legs spaced apart a first distance and the webs of the opposed rails 21 are spaced apart a second distance such that they together define a confinement area (as seen in a plane perpendicular to the axis of rotation of the storage frame 17, that is the plane of FIG. 2) less than is required for the flange or other gripping structure of the highway markers 24 to cant so that they could be removed radially.

Each of a plurality of the exemplary highway markers, e.g. 24C, has a width in each of the two dimensions that are horizontal in FIGS. 1 and 2, respectively, and a height in the third dimension that is vertical in FIGS. 1 and 2. These dimensions are referenced to when the highway markers 24 are in a normal position on the highway 25, for example the position of highway markers 24A in FIGS. 1 and 3.

Each pair of rails 21 constitutes a slide bearing mounted on the storage frame 17 for rotation therewith about the bearings 18, and the slide bearings are at preferably equally spaced apart intervals in circular loci around the horizontal axis of rotation.

Each of the slide bearings is configured to confine a linear array of highway markers 24, for example the array of highway markers 24B and the separate array of highway markers 24C, against movement in one of the two normally horizontal dimensions, which is vertical for the array of highway markers 24B and horizontal for the highway markers 24C in the plane of FIG. 2 with reference to Cartesian coordinates. That is this confinement is tangential for both the array of highway markers 24B and the array of the highway markers 24C, with reference to angular coordinates. The confinement is also with respect to the normally third dimension, which is vertical for the array of highway markers 24C and horizontal for the array of highway markers 24 B in the plane of FIG. 2 with reference to Cartesian coordinates. This second confinement is radial for both the array of highway markers 24B and the array of the highway markers 24C, with reference to angular coordinates about the axis of rotation of the storage frame 17. Both arrays of highway markers 24B and 24C are free for sliding movement along the other of the two normally horizontal dimensions, which is horizontal in the direction of the axis of rotation for both the array of highway markers 24B and the highway markers 24C with reference to Cartesian coordinates or axial for both the array of highway markers 24B and the array of the highway markers 24C with reference to angular coordinates about the axis of rotation. This sliding movement is within at least a range of linear length of the slide bearings.

Friction adequately holds the highway markers 24 within the rails 21 of the slide bearings, even under highway travel conditions. Fixed or retractable stops, not shown, may be provided at the rear and front of all the slide bearings, but preferably, as shown, there are no such stops.

A transfer station on the main frame 12 has a generally planar, horizontal support 27 for a single highway marker 24D. The illustrated indexed or selected rotational position of the storage frame 17 aligns the support 27 with one of the slide bearings, which in the example is the slide bearing confirming and guiding the array of highway markers 24C. A powered abutment 63 is selectively driven and retracted in the direction perpendicular to the plane of FIG. 2. When driven to the left in FIG. 1, the powered abutment 63 slides the entire array of highway markers 24C forward (to the left in FIG. 1).

When the support 27 is empty of a highway marker 24, the highway markers 24C move a distance substantially equal to the overall corresponding width of a highway marker 24 to place the lead highway marker 24C onto the support 27 and then the powered abutment 63 is deactivated by a control, which is a photocell sensor 52 as shown or may be a limit switch (not shown). Here, as elsewhere, the specific form of control or sensor is not critical or necessary to the invention. The immediately adjacent highway marker 24C is thereby slid from the aligned one of the slide bearings of the storage frame 17 onto the support 27 that defines the transfer station inboard of the trailer 1.

The powered abutment 63 is moved to the right and left in FIG. 1 by attachment to a cable that is wound and unwound from the drums of opposed winches 64 that are mounted on the main frame 12.

A transfer mechanism 28 is pivotally mounted at one, preferably lower, end by bearing 29 attached to the main frame 12 to provide for rotation of the transfer mechanism 28 about a horizontal axis, spaced from and generally parallel to the axis of rotation of the storage frame 17. The transfer mechanism 28 is rotated by motor 30 between three positions, namely: (1) a first, transfer station, inboard position (shown in FIGS. 1, 2, 10, 12, 13 and 15) where the pickup 31A supported thereby is at a distance greater than or substantially equal to the height of the highway markers 24 above and vertically aligned with the support 27; (2) a second, highway station, outboard position (shown in FIGS. 3, 9, and 14) transversely outward of the wheeled vehicle above the highway a distance greater than or substantially equal to the height of the highway markers 24 supported on the highway; and (3) a third, highway station, outboard position (shown in FIGS. 5 and 16) transversely outward of the wheeled vehicle above the highway a distance greater than or substantially equal to the height of the highway markers 24 on the retrieval attachment in the position of FIG. 5. Preferably, the height of the pickup 31A above the road is the same for position (1) and (3) for simplifying the controls as disclosed below.

The pickup 31 (31A or 31B) that is mounted on the transfer mechanism 28 exerts an upward attraction force on an uppermost portion of an adjacent highway marker 24 (FIGS. 1, 2, 3, 5, 9, 10, 12, 13, 14, 15 and 16). When the pickup 31 is activated, the attractive force is substantially greater than a weight of a highway marker and sufficient to suspend the highway marker while the transfer mechanism moves between the first and second positions during lay down, and between the first and third positions upon retrieval.

Most preferably, the pickup 31A is an electro-magnet as shown in FIGS. 1 and 2, and the highway marker has an iron piece, or magnetically equivalent, piece attached to its top for this purpose. The attractive force may be generated by other means, for example by creating a vacuum within the cone 31B of FIG. 3 or by a conventional three prong grabber 31C as shown in FIG. 3A. The electro-magnetic pickup 31A has the advantage of not requiring a constantly running vacuum pump or delay of obtaining a vacuum, but the disadvantage of requiring the top of the highway marker to be of a material attracted by magnetic forces, e.g. a ferromagnetic material such as iron or common steel, or lightweight magnetic plastic/ceramic/rubber that is flexible/stiff with fillers of iron or ferro compounds or alloys.

Figure 5:
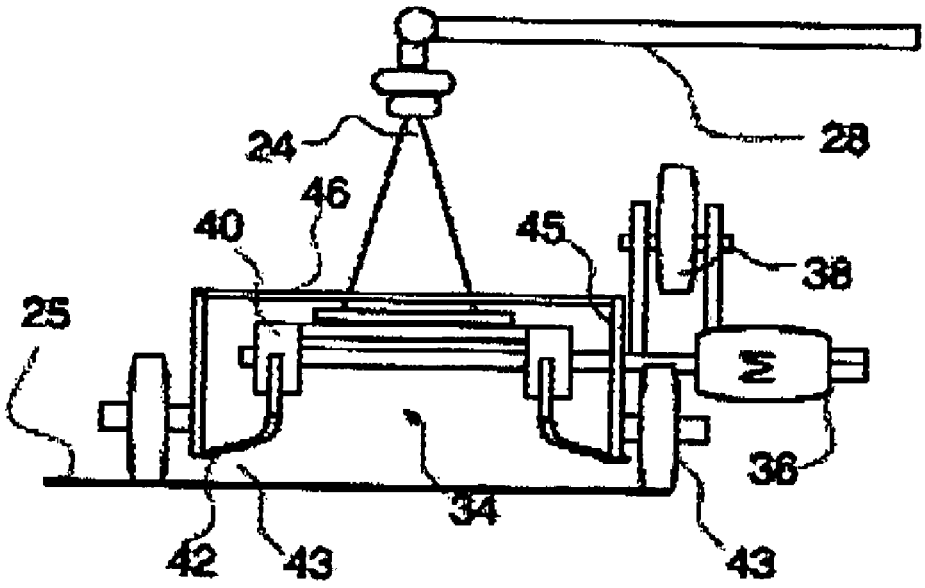
FIG. 5 is a front view of the retrieval attachment in an orientation that is to be assembled to the right side of the wheeled vehicle of the embodiment of FIG. 1 as in FIG. 6 (it may be assembled to either side), and in the position after lifting of a partially retrieved highway marker.
Figure 6:
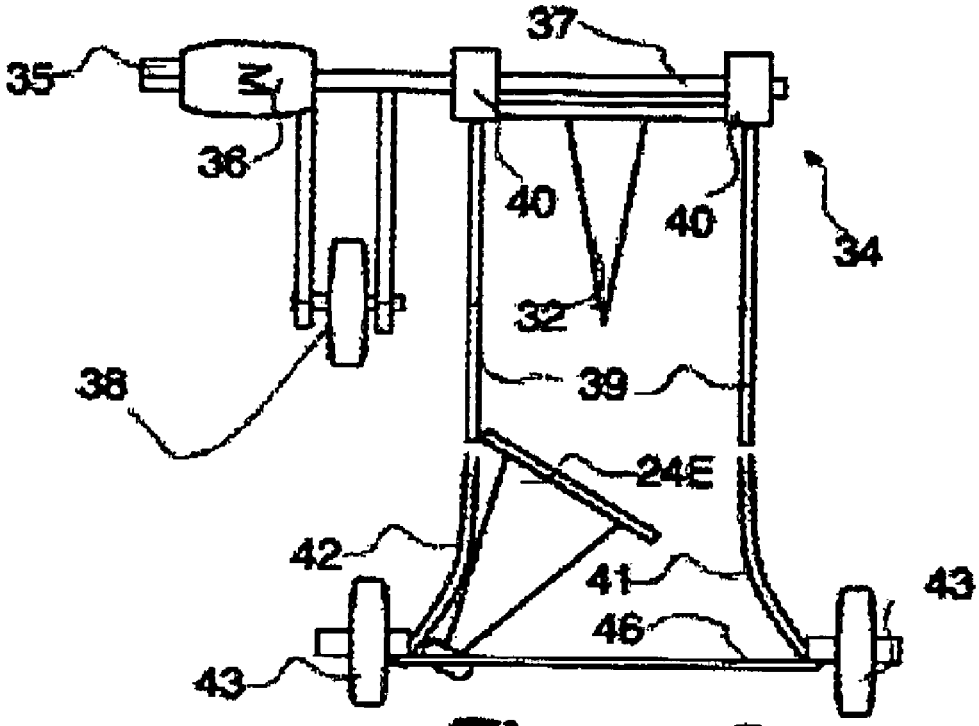
FIG. 6 is a plan view of the retrieval attachment of FIG. 5, in an orientation that is to be assembled to the left side of the wheeled vehicle of the embodiment of FIG. 1, and in the position to orient a highway marker that is still on the highway, so that it may be rotated about a vertical axis and thereafter telescopically engaged as the wheeled vehicle is moved in the forward direction, which direction is downward in the figure.

Next, the attachment mechanism used to retrieve a highway marker is described. The attachment 34 shown in FIGS. 5 and 6 is removable attached to either side of the wheeled vehicle 1 or 3, for example the left side of the vehicle as viewed in FIG. 1 or the right side as viewed in FIG. 10. Preferably, a socket 33 is provided at mirrored positions on each side of the wheeled vehicle. The attachment 34 has a non-circular end 35 that is non-rotatably and telescopically received within either the mating socket 33 (FIG. 1) or the identical socket on the other side of the wheeled vehicle 1 (FIG. 10). A power device, e.g. a reversible motor 36, is controlled to pivot a support 37, preferably a shaft, of the attachment about a generally horizontal axis that is perpendicular to the generally horizontal axis of the storage 17. Alternatively, the motor 36 may be removed from the attachment 34 and mounted on the frame 12 to rotate the socket 33. This pivoting is selective and reversible between the positions of FIGS. 5 and 6.

The support 37 has fixedly mounted thereon a rotatable support wheel 38. A generally horizontal cantilevered member 32 is fixedly attached to the support 37 for rotation therewith. Preferably, the rotation axis of the wheel 38 is transversely, generally aligned with the terminal end of the cantilevered member 32, as shown by the dotted line in FIG. 6, so that the wheel engaging the highway at a contact point generally transversely aligned with the terminal end of the cantilevered member 32 accurately determines the elevation of the cantilevered member 32, particularly to fix the height of the terminal end of the cantilevered member 32 to be about at the mid width of the base of the highway marker on its side, to facilitate telescopic engagement or insertion independently of the height of the main frame 12 or unevenness or bumps in the highway.

A highway marker guide and highway marker reorientation frame 39 is freely pivoted on the support 37 by bearings 40 to move relative to the support 37 at least for the range of the pivoting of the member 32 and wheel 38. As shown in the plan view of FIG. 6, when the wheeled vehicle is moving toward the bottom of FIG. 6, i.e. forward, a randomly oriented highway marker lying on its side, after being accidentally knocked over, e.g., is engaged by the generally horizontally extending and outwardly flared arms 41, 42, so that the highway marker 24E is rotated to have the hollow end of the highway marker 24 aligned with and then relatively moved telescopically onto the member 32. An advantage of the present invention is that the arms 41, 42 are provided with one or more (two being illustrated) rotatable wheels 43 that will engage the highway 25. The wheels 43 determine the height of the terminal, forward end of arms 42,43 and the bar 46, while the wheel 38 independently determines the height of the member 32 above the highway to reliably align the member 32 with the relatively approaching highway marker 24. Without this feature, a bump, tolerances, wear, a hill or the like may cause the member 32 to be sufficiently misaligned as to be unable to nest with the highway marker 24. The converging arms 41, 42 and wheel 43 will guide a misaligned highway marker 24 to be horizontally aligned with the member 32, while the wheel 38 will guide the forward end of the member 32 to be vertically aligned with the highway marker 24. Although less desirable, the wheels 38 and 43 could be each be replaced by a skid.

For retrieving a highway marker 24 that is in a normal highway position, such as that of highway marker 24A in FIG. 1 or FIG. 10, the attachment 34 has upstanding posts 45 fixedly secured to the leading ends of the arms 41, 42, respectively, and a bar 46 fixedly secured to the upper ends of the posts 45. The bar 46 forms a horizontally extending abutment that is generally across the relative path of an upright highway marker 24A, but spaced above the path of a highway marker 24E that is on its side. The bar/abutment 46 will thereby knock down an upright highway marker 24A so that it will assume an orientation similar to that of highway marker 24E, so that it will be eventually aligned with the member 32 for nesting therewith.

Retrieving a highway marker broadly involves maneuvering the wheeled vehicle, e.g. as shown in FIG. 12 or 13, so that the generally horizontal cantilevered member 32, of FIG. 6, is inserted within a highway marker 24E that is freely supported on the highway 25. Most preferably, the cantilevered member 32 is of a shape to nest loosely within and from the bottom of a highway marker 24, which shape is illustrated as conical to nest within the hollow cone example of a highway marker 24. The illustrated specific shape of the cantilevered member is not critical or necessary, other than to be complimentary with that of the highway marker 24 exposed interior to telescope sufficiently to lift the marker when moved from the position of FIG. 6 to that of FIG. 5. For example, the cantilevered member 32 could be a truncated cone, a rotation of half an oblong or cylindrical, e.g. some highway markers 24 are cylindrical inverted cans. Thereafter the cantilevered member 32 with the nested highway marker 24 is moved, preferably pivoted ninety degrees as illustrated in the embodiment from the position of FIG. 6 to the position of FIG. 5. Therefore, the highway marker 24 is in a generally upward orientation, as shown in the end elevation view of FIG. 5, and at a height above the highway 25 that is substantially equal to the height above the highway of the platform 27.

Figure 17:
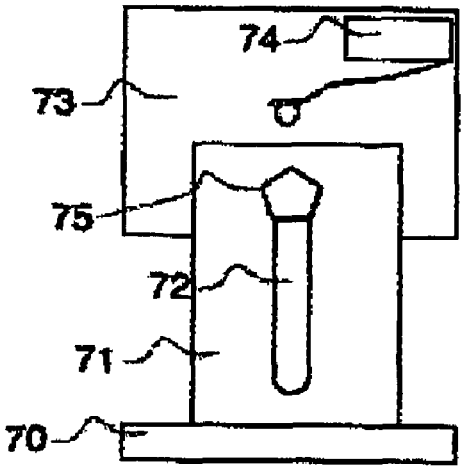
FIG. 17 shows the lost motion connection of the pickup that senses a marker.
Figure 18:
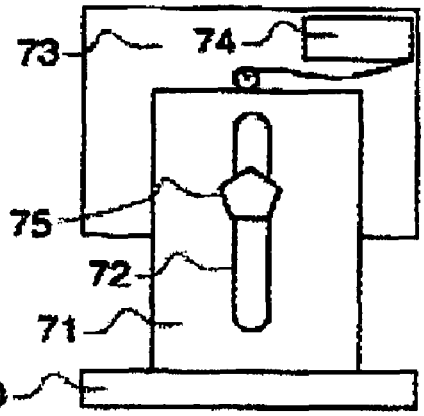
FIG. 18 is another view of the connection of FIG. 17, but in the position where it is sensing engagement with a marker as the pickup is lowered onto the marker.

Thereby, with respect to FIGS. 18 and 19, in the retrieval mode and lay-down modes, the controls determining the limits of movement of the pickup 31 at D, C of FIG. 18 (e.g. limit switches) used to determine the height of pickup 31 above the highway on one side (FIG. 18) of the trailer are the same controls to provide limits D, C used to determine the height of pickup 31 above the support 27 on the other side (FIG. 19) of the trailer in the lay-down and retrieval modes, respectively. The switch 57 is used to reconfigure the circuit having the limit switches or their equivalents, accordingly. The limit switches for limits A, D are preferably one limit switch 74 of FIGS. 16, 17, as described below. The limits B, C are preferably built into the drive 29, 30, and most preferably, the limits A, B, C, D are adjustable.

Then, the highway marker 24D of FIG. 1 is moved from the support 27 into the array of highway markers 24C by a pusher 88 being reciprocated rearward by motor 84 (if not already done), and the transfer mechanism 28 is rotated from the position of FIG. 1 to the position of FIG. 16 where the pickup 31 is activated (if not already active) to engage the highway marker 24. Next the transfer mechanism 28 with the suspended highway marker is moved from the position of FIG. 16 to the position inboard as shown in FIG. 1 and 2. These processes are controlled by the enabler 54B under control as shown with respect to FIG. 4.

Assuming the driver or operator of the wheeled vehicle (a self-contained truck as in FIG. 13 or a combination trailer and tow vehicle of FIG. 12) is positioned to the left, as is the positioning for a driver in the United States, the driver will easily see the highway marker and attachment directly by turning their head or using a near side mirror for laying down or retrieving highway markers on the driver's side as in FIGS. 1 and 9. However, if the highway markers are to be laid down or retrieved from the side opposite to the operator's side, visibility will be limited. To facilitate the retrieval from the opposite side to the driver, the attachment 34 is mounted on the other side as mentioned above using the socket 33 on the other side of the vehicle as shown in FIG. 16.

There are times when the highway markers 24 are to be laid down or retrieved from either side of the wheeled vehicle 1, 2 or 3. The following provisions are for this purpose. The assembly of the transfer mechanism 28, pickup 31, bearing 29 and motor 30 are carried on the frame 12 for bodily movement from the left side of the trailer in FIG. 2 to the right side of the trailer in FIG. 15. This movement is preferably accomplished with a slide rail connection (shown) between the two positions, but also the entire assembly may be unbolted (not shown), moved and re-bolted in the new position. The attachment 34, of FIGS. 5 and 6, is pulled from the socket 33 of the main frame, flipped side to side and re-attached to the socket 33 on the other side of the wheeled vehicle 1, 2 or 3.

Figure 4:
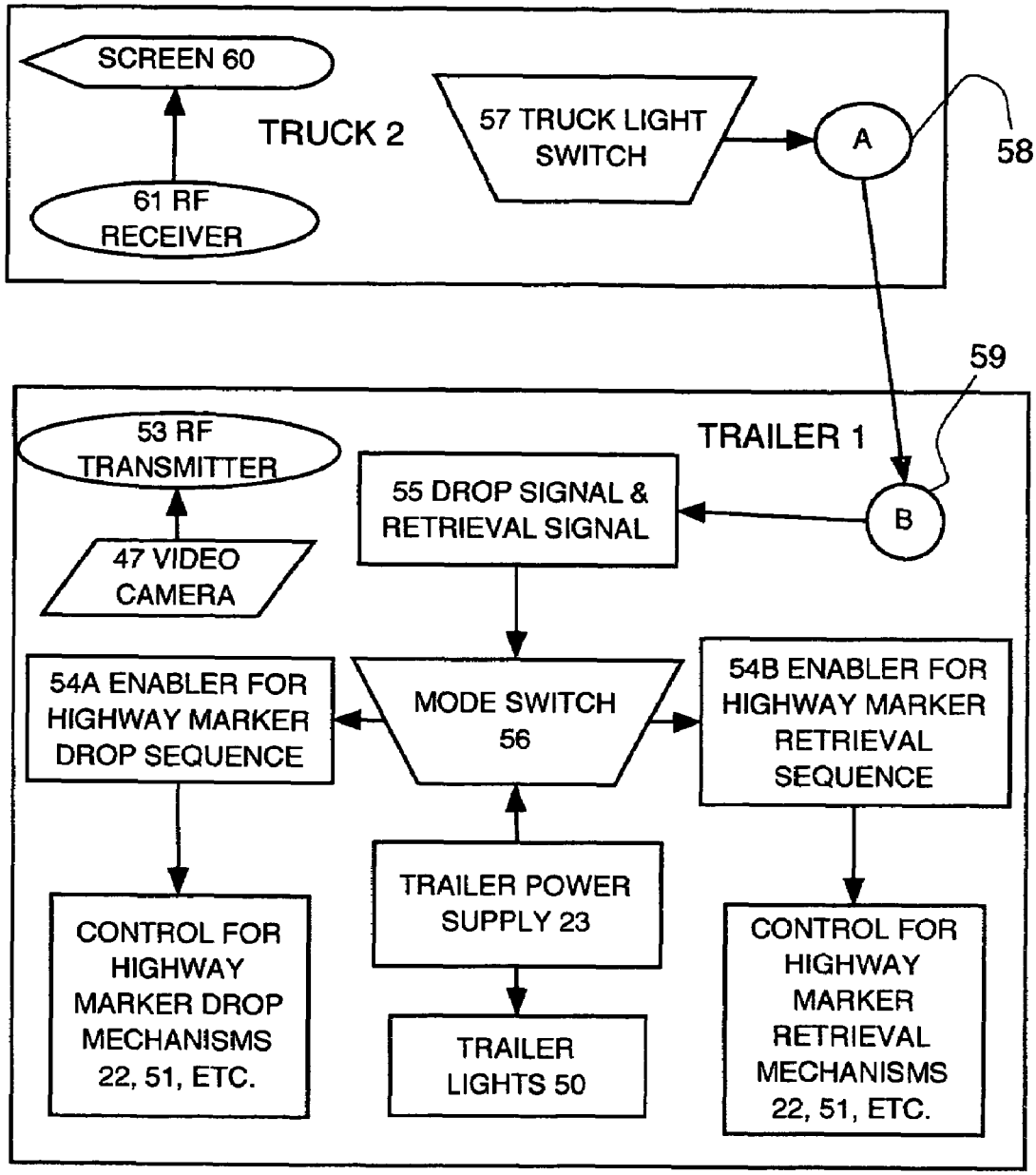
FIG. 4 is a schematic of the controls employed in the wheeled vehicle of FIG. 1 and in the tow vehicle (truck) of FIG. 12 for towing the trailer, as well as in the self-powered vehicle of FIG. 13.

To solve the problem of decreased visibility for the driver when the attachment 39 is mounted on the driver's side or, even worse, the non-drivers side, a video camera 47, FIG. 1 or 10 respectively, is positioned to record the environment of the highway adjacent to the attachment 34, that is the highway station, as a video stream. In the preferred embodiment, the video stream is wirelessly transmitted in real time to the driver's cab, e.g. of the tow vehicle, e.g. by a radio frequency transmitter 53 of FIG. 4. In FIG. 4, it is seen that the transmitter 53 is connected to receive and transmit the video stream from a selected one of or both of the cameras 47. The video stream is wirelessly received by the RF receiver 61 and fed in real time to a monitor or screen 60 located where the driver is normally located, for example in the cab of the tow truck 2 of FIG. 12 or in the cab of the complete truck 3 of FIG. 13. Of particular advantage to the trailer embodiment, the monitor of screen 60 is portable, for example secured to the dashboard or windshield by a suction cup and powered by being plugging into a standard cigarette lighter outlet or standard DC power outlet that is normally used to power a cell phone, laptop or the like. The monitor or screen 60 may be a part of a standard laptop or dashboard mounted or built-in GPS navigation and/or instrumentation display.

A standard tow package for a powered vehicle, such as the truck 2 of FIG. 12, includes the tow hitch 10 on the trailer and 11 on the truck, which together provide the mechanical connection as well as a releasable connector (58, 59 of FIG. 4) for electrical connection from the tow vehicle to the trailer, thereby with the latter connection 58,59, the trailer receives at least lights-on and brake signals from the tow vehicle. Most preferably, the activation signal 57 of FIG. 4, mentioned above for the pickup 31, for example to operate a relay to connect the electro-magnet 31A with the power supply 23, is the lights-on signal obtained from the truck light switch 57 of FIG. 4. Less desirably, a dedicated electrical connection between the pickup 31 and the trailer is hardwired into the vehicle 3 of FIG. 13 and used to send the activation signal 56 for the pickup 31 from the light switch 57 or a dedicated switch. Thereby, the driver of the tow vehicle turns on the tow vehicle lights to activate (lift or hold a highway marker 24) or deactivate (to drop or release a highway marker 24) the pickup 31, e.g. activate the electro-magnet 31A to attract the highway marker for transfer or deactivate to de-energize the electro-magnet 31A and drop the highway marker 24 A, in FIG. 2, at the appropriate time. This signal 55 is preferably of the same origin and takes on a laydown or retrieval aspect according to the vehicle controls being in the laydown or retrieval mode, selectively as determined by switch 56.

Preferably the power for the powered devices (e.g. RF transmitter 53, the video camera 47, the electro-magnet 31A, the motors 30, 36, 62, 64, etc.) of the trailer 1 is provided by the power source 23, e.g. a battery, located on the trailer main frame 12.

The RF transmitter 53, the video camera 47, the electro-magnet 31A, the motors 30, 36, 62, 64, etc., the onboard power source 23, and the pickup control signal being transmitted over a wireless or releasable standard lights hookup line each and especially collectively permit the use of a tow vehicle of minimum cost since the tow vehicle is not modified beyond a standard tow package. Also, the trailer is of minimum cost since the trailer does not need a drive engine, transmission, driver's cab, room for two assistants, or complex mechanisms to unstack highway markers.

In FIG. 4, the controls employed in the wheeled vehicle 1, preferably a trailer of FIG. 1, are connected to the operator controls.

In the operator's cab, there is a manually activated (e.g. hand, foot or voice activated) signal generator (e.g. an electrical switch), which preferably controls a normal vehicle operation, such as the lights-on switch 57 to turn on the outside lights 50 (e.g. front headlights, taillights and side lights) of the operator/driver's vehicle, which in the preferred embodiment is the tow truck 2. The thus produced signal is also fed to the releasable standard trailer connector A, 58, which may be plugged into the releasable standard trailer connector B, 59, to provide the lay down and retrieval signals. This single signal (e.g. lights-on) may selectively function for either lay down or retrieval depending upon whether the system is in the lay down mode of FIG. 7 or the retrieval mode of FIG. 8, as determined by the mode switch 56.

Further, the operator's cab includes an RF (Radio Frequency) Receiver 61 to provide a streaming video signal from a selected one of cameras 47 to monitor 60. The Screen 60 and RF Receiver 61 may be integrated in a conventional laptop or portable computer, or integrated into a built-in computer that has other main functions such as GPS navigation, engine monitoring, brake monitoring, etc. The one or more video cameras 47 are mounted on the trailer 1 of FIG. 12 or the integrated truck 3 of FIG. 13 to capture the operations of the transfer mechanism 28 and the attachment 39, as well as the environment of the transfer station at support 27 and the highway station. A streaming video signal is provided by the cameras 47 and wirelessly transmitted, e.g. by the RF Transmitter 53. Alternately, the video feed could be through the connection A, B, with modifications of the connector or hard wired for FIG. 13.

The wireless video communication, the use of a portable monitor/laptop or built-in monitor supplied with the truck and the use of a standard vehicle operating signal for lay down and retrieval modes, each contribute to eliminating the need to modify the equipment of the operator's cab, which is a particularly valuable asset in the use of separate tow and trailer wheeled vehicles as in FIG. 12.

Figure 7:
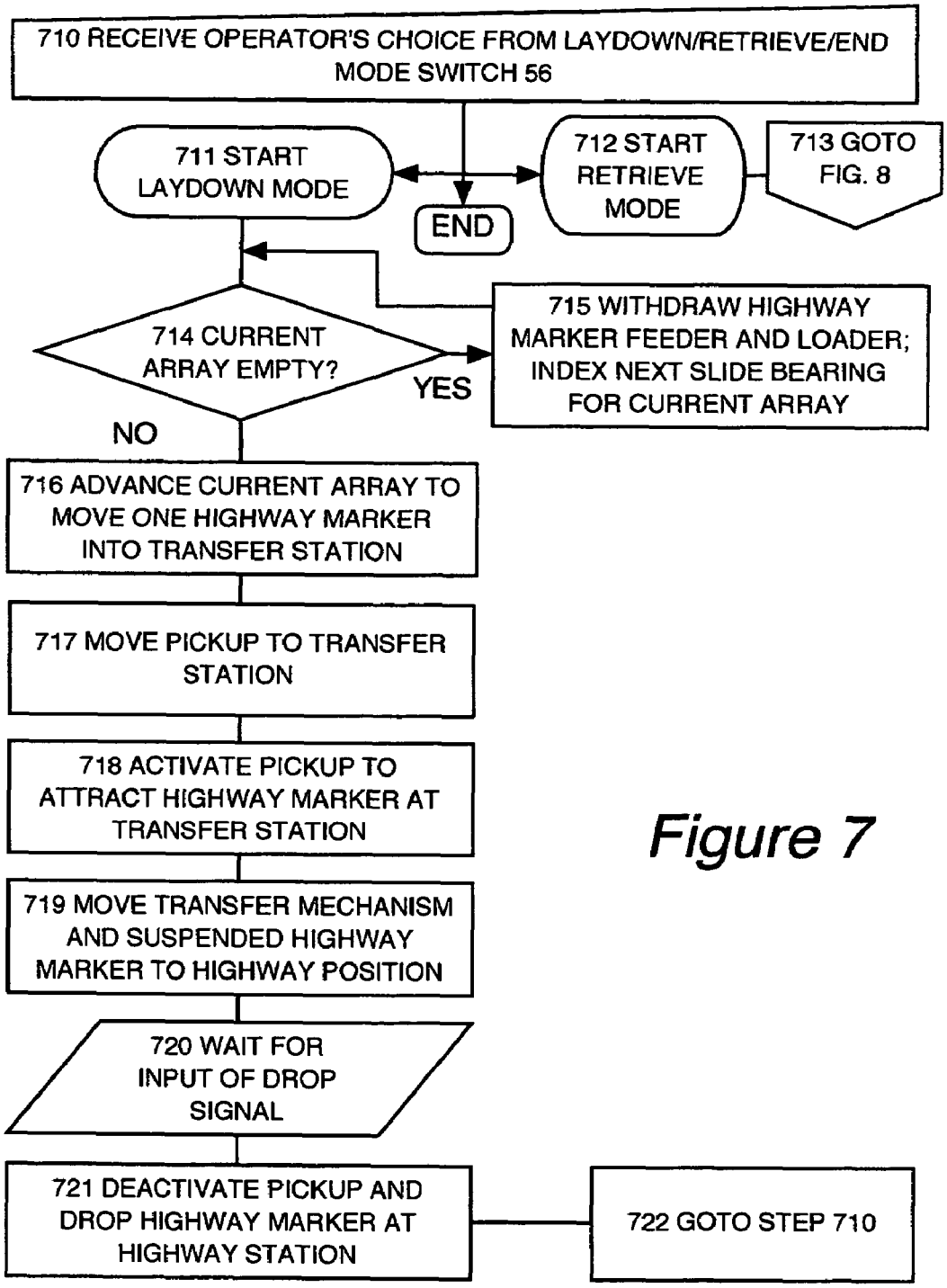
FIG. 7 is a flowchart of the processing for the highway marker lay down mode of operation.
Figure 8:
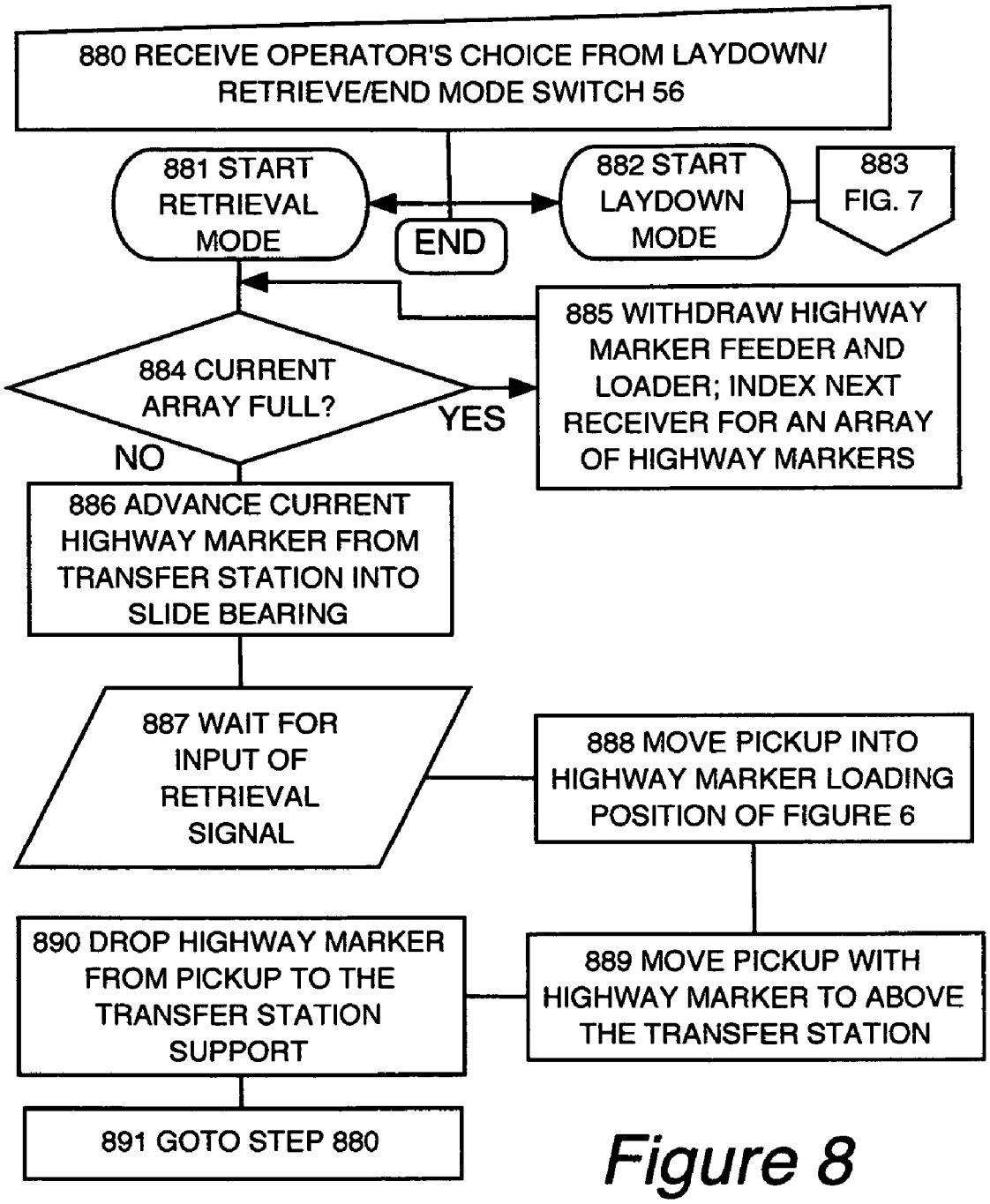
FIG. 8 is a flowchart of the processing for the retrieval mode of operation.

A control module, 49 in FIG. 1, houses a drop/retrieval mode switch 56 shown in FIG. 4, which is preferably manually operated to selectively switch the operation of the trailer between the lay down mode of FIG. 7 and the retrieval mode of FIG. 8, according to step 710 or step 880 of FIGS.

7 and 8, respectively. The respective enablers 54A and 54B of FIG. 4 are a general purpose computer that is provided with software as described according to the flowcharts of FIGS. 7 and 8, or by hardwiring within the control module 49 described according to the flowcharts of FIGS. 7 and 8, or by an ASIC or EPROM configured as described according to the flowcharts of FIGS. 7 and 8, for example. The schematically shown controls 22, 51, 52, etc. of FIG. 4 include motors or other mechanical power sources 22, 30, 36, 84, 62, 64, position sensors 51, 52, pickup 31 and interconnecting wiring. The trailer power supply 23 provides electrical power for the trailer lights 50, motors 22, 29, 30, pickup 31, sensors 51, 52, cameras 47, RF transmitter 53, enablers 54 and other power consuming elements of the trailer to make the trailer power independent of the tow vehicle.

FIG. 7 is a flowchart of the processing steps for the lay down mode of operation.

In STEP 710, the operator, who becomes the driver of the truck 2 or 3 and the only human needed to operate any of the embodiments, selects the lay down mode through operation of the switch 56 of FIG. 4, to command the start of the lay down mode according to step 711. Alternatively, the switch 56 is used to select step 712 for the retrieval mode and processing is transferred to FIG. 8 according to step 713.

STEPs 711, 712, 713, 714, 715, 716, 717, 718, 719, 720, 721 and 722 are conducted automatically by the enabler 54A and the control 22, 51, etc.

STEP 714 determines if the current array of highway markers 24C is empty, that is if there are no highway markers 24C in the slide bearing that is aligned with the support 27 at the inboard transfer station. A determination that the current array is empty is made by: a limit switch 62 of FIG. 1 sensing the presence of the feed abutment 63 that is driven left to feed highway markers 24 to the transfer station having support 27 by a cable 65 reversibly driven by a reversible cable drives 64, and photo sensor 52 sensing the absence of a highway marker 24D at the transfer station. With a YES determination, processing proceeds to step 715 and with a NO determination, processing proceeds to step 716.

In STEP 715, the abutment 63, acting as the highway marker feeder 63 is withdrawn, by the cable 65 driven by the cable drives 64, to the rear of the storage frame 17 to be clear of the storage frame rotating. Thereafter, the storage frame 17 is rotated through the angle between adjacent slide bearings, that is indexed, by the indexing motor 22 so that the next slide bearing, pair of rails 21, e.g. the one holding the highway markers 24B, becomes aligned with the support 27 of the transfer station so that the array of highway markers 24B becomes the current array of highway markers. Processing returns to step 714.

In STEP 716, the current array of highway markers is 24B if step 715 was performed or 24C as illustrated in FIG. 1 when step 714 determined a NO. The current array is advanced, to the left in FIG. 1, by the mechanism 63, 64, and 65 until the sensors 52 determine that a highway marker 24D is properly positioned on the support 27 at the transfer station. Note that if step 715 was performed, the highway marker 24D would have come from the lead highway marker 24B and that if step 715 was not performed, the sensor 52 would sense the presence of the highway marker 24D before the feed mechanism 63, 64, 65 moved and there would be no feed.

Figure 15:
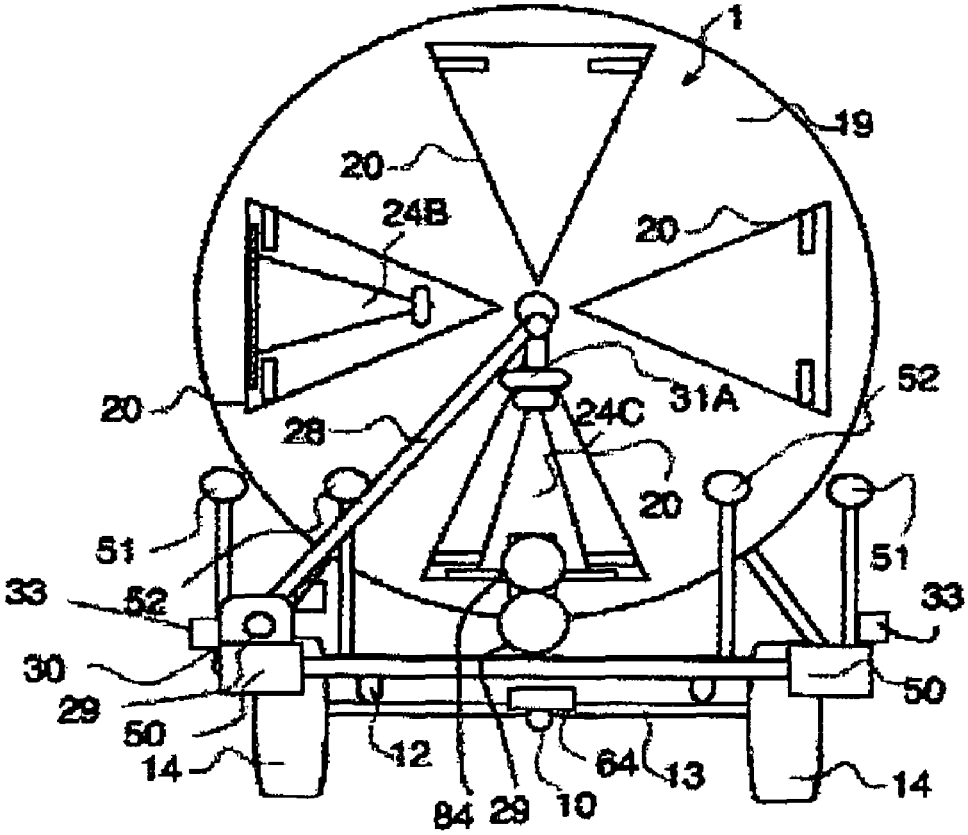
FIG. 15 is a front view of the wheeled vehicle of either FIG. 12 or 13, without the truck or cab respectively, with the transfer mechanism on the right side and at the transfer station.

In step 717, the transfer mechanism 28 is swung from its outboard position in FIG. 3, 9 or 14 where the pickup 31 is at the highway station to its inboard position in FIG. 2 or 15 where the pickup 31 is at the transfer station, unless the transfer mechanism is already at or somewhat above the inboard position and then the movement is less.

STEP 718: In the final small movement to the position of FIG. 2 or 15, the pickup 31 senses the presence of the highway marker 24D and in response the attractive suspension force is applied by the electro-magnet pickup 31A of FIG. 1 or the vacuum pickup 31B of FIG. 3 or the grapple 31 C of FIG. 3A, for example. The attractive force is most preferably magnetic as in the embodiment of FIG. 2. This sensing of when to apply the attractive force may be by a combination of signals coming from the sensor 52 and the motor 30 respectively indicating that the highway marker 24D is present and the pickup 31 has completed its rotation as illustrated, or by a limit switch being activated when the pickup 31 moves upward against the force of gravity toward a limit switch carried by the adjacent part of the transfer mechanism 28 as allowed by a lost motion connection (elongated slots in one and receiving bolts of the other), not shown. Alternatively, the attractive force may always be applied whenever the power supply 23 is active, except when the lights-on signal is received at connector 29.

In STEP 719, the transfer mechanism 28 is swung from its inboard position at the transfer station in FIG. 2 or 15 to its outboard position at the highway station in FIG. 3, 9 or 14. At the highway station, the transfer mechanism stops just short of engaging the suspended highway marker with the highway, although for a less desirable embodiment, the transfer mechanism 28 may engage the highway marker with the highway. Spacing the highway marker above the highway is preferred, because engagement with the highway may cause the highway marker to be torn from the transfer mechanism 28 prematurely by the highway dragging friction overcoming the attractive force of the pickup 31. Preferably, the pickup 31 has a universal joint connection with the remainder of the transfer mechanism 28 to permit swinging about cross horizontal axes.

STEP 720: During one or more of steps 714 to 720, the wheeled vehicle 1 may be in motion, for example moving from the position where highway marker 24A of FIG. 1 was dropped to the illustrated position of the trailer in FIG. 1, where the next highway marker is to be laid or dropped. The process waits for input of the drop signal 55 of FIG. 4, preferably the lights-on signal from the operator. Upon receipt of the drop signal 55, processing proceeds to step 721.

In STEP 721, the drop signal controls a relay, ASIC or computer program in the control 49, which stops the application of power from the power source 23 to the pickup 31, that is deactivates the pickup 31, to drop or release the highway marker onto the highway at the highway station in FIG. 3, 9 or 14.

Then, processing proceeds to step 722, where it is returned to step 710. The above described processing is repeated until the operator changes the switch 56 of FIG. 4. In this regard, switch 56 may be a three-way position switch of: lay down mode and power on leading to step 711; retrieve mode with power on leading to step 712 that in turn leads to the processing of FIG. 8 according to step 713; and power off, "END". Power on and off refers to the connection or disconnection of the power supply 23.

FIG. 8 is a flowchart of the processing for the retrieval mode of operation.

In STEP 880, the operator, who becomes the driver of the truck and the only human that is necessary to operate any of the embodiments, selects the retrieval mode through operation of the switch 56 of FIG. 4, to command the start of the retrieval mode according to step 881. Steps 881, 882, 883, 884, 885, 886, 887, 888, 889, 890 and 891 are conducted automatically by the enabler 54B and the control 22, 51, etc. Alternatively, the switch 56 is used to select step 882 for the laydown mode and processing is transferred to FIG. 7 according to step 883.

STEP 884 determines if the current array of highway markers 24C is full, that is if there is no room for more highway markers 24C in the slide bearing that is aligned with the support 27 of the transfer station. A determination that the current array is full is made by: a limit switch 82 of FIG. 1 sensing the presence of the feed abutment 63 that is driven right as additional highway markers are loaded from the transfer station by retracting cable 65 that is reversibly driven by a reversible cable drive 64 or merely pushed back by incoming highway markers; or by transversely aligned photo sensors 51 having their line of sight interrupted by a highway marker, for example. In FIG. 1, the sensors 51 and/or 82 would determine that the current array is not full and processing would go to step 886. With a YES determination, processing proceeds to step 885 and with a NO determination, processing proceeds to step 886.

In STEP 885, the abutment 63, acting as the highway marker feeder is already in a position withdrawn to the rear of the storage frame 17 to be clear of the storage frame rotating and this is confirmed. Thereafter, the storage frame 17 is rotated by the angle between adjacent slide bearings, that is indexed, by the indexing motor 22 until the next slide bearing (pair of rails 21, e.g. the one to the left of the current one in FIG. 2) becomes aligned with the support 27 of the transfer station. Then control is returned to step 884.

In STEP 886, the highway marker 24D is pushed from the support 27 of the transfer station onto the adjacent slide bearing (pair of rails 21) by the loader 88 that is moved to the right in FIG. 1 an amount equal to or greater than the corresponding width of the highway marker 24D by the motor 84. Thereby the current array of highway markers, for example 24C in FIG. 1 if step 885 was not performed, is moved to the right in FIG. 1. Note that if step 885 were performed, the highway marker 24D would now be the only highway marker in the current array.

STEP 887 waits for input from the operator/driver. During this step and/or during one or more steps prior or after, the wheeled vehicle 1 may be in motion, for example to engage the attachment 34 with a highway marker 24 that is on the highway as shown in FIG. 6 as explained above. The process waits for input of the retrieval signal, preferably the lights-on signal 57 of FIG. 4. Upon receipt of the signal, processing proceeds to step 888.

In STEP 888, the highway marker is moved to the state of FIG. 5. Then the transfer mechanism 28 and pickup 31 is swung from its inboard position at the transfer station in FIG. 2 or 15 to its outboard position at the highway station as shown in FIG. 16. In the final small movement to the position of FIG. 16, the pickup 31 senses the presence of the highway marker 24 and in response, the attractive force is applied by the electro-magnet pickup 31A or the vacuum pickup 31B, for example. The attractive force is most preferably magnetic as in the embodiment of FIG. 2. This sensing of when to apply the attractive force may be in accordance with flue example sensor of FIGS. 16 and 17. A limit switch 74 is mounted on plate 73 of transfer mechanism 28. The electro-magnet 70 is rigidly mounted on plate 71. The plate 71 has a through vertical slot 72 receiving therein the shaft of a bolt 75 that is threaded fixedly in the plate 73 so that there is lost motion vertically between the plates 71 and 73. When the marker 24 is on the support 27 or the highway 25 and engaged by the electro-magnet 70, further movement will move the plates 71 and 73 toward each other, FIG. 16 to FIG. 17, which will activate switch 74, thereby sensing the presence of the marker 24. Alternatively, the attractive force may always be applied whenever the power supply 23 is active, except when the lights-on signal is received at connector 29.

In STEP 889, the transfer mechanism 28 and attached pickup 31 are swung from preferably stops when the weight of the suspended highway marker is sensed as transferred to the support 27.

In STEP 890, the sensed transfer of step 889 activates a relay or computer program step in the control 49, which stops the application of power from the power source 23 to the pickup 31, that is, deactivates the pickup 31. This will cause the drop or release of the highway marker onto the support 27 at the transfer station.

Then, processing proceeds to step 891, where it is returned to step 880. The above described processing is repeated until the operator changes the switch 56. In this regard, switch 56 may be a three-way position switch of: lay down mode and power on leading to step 882 that in turn leads to the processing of FIG. 7 according to step 883; retrieval mode with power on leading to step 881; and power off "END" in FIG. 8. Power on and off refers to the connection or disconnection of the power supply 23, of FIGS. 1 and 4.

Some of the steps of FIGS. 7 and 8 may be combined, rearranged in order, divided, run in parallel, etc; that is, the steps are merely one example of how to make and use the overall process.

While the present invention has been described in connection with a number of embodiments, implementations, modifications and variations that have advantages specific to them, the present invention is not necessarily so limited but covers various obvious modifications and equivalent arrangements according to the broader aspects, which fall within the spirit and scope of the following claims.

What is claimed is:

1. A wheeled vehicle for transporting highway markers and for exchanging the highway markers between the wheeled vehicle and a highway, the highway markers having a width in each of two dimensions that is horizontal and a height third dimension as seen when the highway markers are in a normal position on the highway, said wheeled vehicle comprising:

a main frame;

at least one wheel mounted for rotation on said main frame to engage the highway and thereby supporting said mainframe;

a storage frame mounted on said main frame for rotation about a generally horizontal axis of rotation;

a plurality of slide bearings mounted on said storage frame for rotation therewith at spaced apart intervals around the horizontal axis of rotation; and each of said slide bearings being configured to confine a linear array of the highway markers against movement in one of the two dimensions and the third dimension, and allow sliding movement along the other of the two dimensions within at least a range of linear length of the array.

2. A wheeled vehicle for transporting highway markers and for exchanging the highway markers between the wheeled vehicle and a highway, the highway markers having a width in each of two dimensions that is horizontal and a height third dimension as seen when the highway markers are in a normal position on the highway said wheeled vehicle comprising:

a main frame:

at least one wheel mounted for rotation on said main frame to engage the highway and thereby supporting said mainframe;

a storage frame mounted on said main frame for rotation about a generally horizontal axis of rotation;

a plurality of slide bearings mounted on said storage frame for rotation therewith at spaced apart intervals around the horizontal axis of rotation;

each of said slide bearings being configured to confine a linear array of the highway markers against movement in one of the two dimensions and the third dimensions, and allow sliding movement along the other of the two dimensions within at least a range of linear length of the array; and wherein each of said slide bearings has both the linear length and the other of the two dimensions parallel to the axis of rotation.

3. The wheeled vehicle of claim 2, wherein each of said slide bearings is equidistant from immediately adjacent slide bearings and equidistant from the axis of rotation; and each of said intervals being at least equal to a width of said highway markers.

4. The wheeled vehicle of claim 3, wherein each of said slide bearings is mounted and configured so that the third dimension of each highway marker of its array is radial with respect to the axis of rotation.

5. A wheeled vehicle for transporting highway markers and for exchanging the highway markers between the wheeled vehicle and a highway, the highway markers having a width in each of two dimensions that is horizontal and a height third dimension as seen when the highway markers are in g normal position cm the highway, said wheeled vehicle comprising:

a main frame;

at least one wheel mounted for rotation on said main frame to engage the highway and thereby supporting said mainframe;

a storage frame mounted on said main frame for rotation about a generally horizontal axis of rotation;

a plurality of slide bearings mounted on said storage frame for rotation therewith at spaced apart intervals around the horizontal axis of rotation;

each of said slide bearings being configured to confine a linear array of the highway markers against movement in one of the two dimensions and the third dimension, and allow sliding movement along the other of the two dimensions within at least a range of linear length of the array;

a transfer station on said main frame and having a support for a single highway marker;

a powered index mechanism connected to rotate said storage frame to one rotated position about the axis of rotation where said support is adjacent to and aligned with one of said slide bearings; and a powered abutment for sliding an immediately adjacent highway marker of said aligned one of said slide bearings from said aligned one of said slide bearings onto said support of said transfer station along the other of the two dimensions.

6. The wheeled vehicle of claim 5, wherein said aligned one of said slide bearings has the third dimension vertical.

7. The wheeled vehicle of claim 6, further comprising:

a transfer mechanism pivotally mounted at one end on said main frame to rotate about an axis, spaced from and generally parallel to the axis of rotation of said storage frame, for powered movement of another end between a first position at a distance at least equal to the height of the highway markers above and vertically aligned with said support, and a second position transversely outward of said wheeled vehicle above the highway a distance greater than or equal to the height of the highway markers.

8. The wheeled vehicle of claim 7, further comprising:

a pickup mounted on said another end of said transfer mechanism capable of exerting an upward attraction force on an uppermost portion of a highway marker substantially greater than a weight of the highway marker, when activated, and sufficient to hold the highway marker on said another end while said transfer mechanism moves between said first and second positions.

9. The wheeled vehicle of claim 2 in the form of a trailer further comprising:

a tow hitch for towing attachment to a tow vehicle;

a releasable connector for electrical connection with the tow vehicle to receive at least lights-on and brake signals from the tow vehicle; and an electrical connection between said releasable connector and said pickup to control activation of said pickup with an electrical control signal.

10. The trailer of claim 9, wherein the control signal is the lights-on signal.

11. The trailer of claim 9, further including an electrical power supply for said pickup, said transfer mechanism, powered abutment and said powered index mechanism.

12. A trailer for transporting highway markers and for exchanging the highway markers between the wheeled vehicle and a highway, the highway markers having a width in each of two dimensions that is horizontal and a height third dimension as seen when the highway markers are in a normal position on the highway said wheeled vehicle comprising:

a main frame;

at least one wheel mounted for rotation on said main frame to engage the highway and thereby supporting said mainframe;

a storage frame mounted on said main frame for rotation about a generally horizontal axis of rotation;

a plurality of slide bearings mounted on said storage frame for rotation therewith at spaced apart intervals around the horizontal axis of rotation;

each of said slide bearings being configured to confine a liner array of the highway markers against movement in one of the two dimensions and the third dimension, and allow sliding movement along the other of the two dimensions within at least a range of linear length of the array;

a tow hitch for towing attachment to a tow vehicle; a releasable connector for electrical connection with the tow vehicle to receive at least lights-on and brake signals from the tow vehicle;

a transfer station on said main frame and having a support for a highway marker;

a transfer mechanism mounted at one end on said main frame for powered movement of another end between a first position at a distance greater than or equal to the height of the highway markers above and vertically aligned with said transfer station, and a second position outward of said wheeled vehicle above the highway a distance greater than or equal to the height of the highway markers;

a pickup mounted on said another end of said transfer mechanism capable of exerting an upward attraction force on an uppermost portion of a highway marker substantially greater than a weight of the highway marker, when activated, and sufficient to hold the highway marker on said another end while said transfer mechanism moves between said first and second positions; and an electrical connection between said releasable connector and said pickup to control activation of said pickup with an electrical control signal.

13. The trailer of claim 12, wherein the control signal is the lights-on signal.

14. A wheeled vehicle for transporting highway markers and for exchanging the highway markers between the vehicle and a highway, the highway markers having a width in each of two dimensions that are horizontal and a height third dimension as seen when the highway markers are in a normal position on the highway, said wheeled vehicle comprising:

a transfer station having a support for a single highway marker;

a transfer mechanism mounted at one end for movement of another end between a first position aligned with said transfer station, and a second position outward of said vehicle above the highway;

a pickup mounted an said another end of said transfer mechanism capable of exerting an upward attraction force on an uppermost portion of a highway marker substantially greater than a weight of the highway marker, when activated, and sufficient to hold the highway marker on said another end while said transfer mechanism moves between said first and second positions;

a tow hitch for towing attachment to a tow vehicle;

a releasable connector for electrical connection with the tow vehicle to receive at least lights-on and brake signals from the tow vehicle; and an electrical connection between said releasable connector and said pickup to activate said pickup with an electrical control signal.

15. The trailer of claim 14, wherein the control signal is the lights-on signal.

16. The trailer of claim 14, further including an electrical power supply for said pickup.

17. A method for carrying highway markers on a wheeled vehicle, the highway markers having a width in each of two dimensions that are horizontal and a height third dimension as seen when the highway markers are in a normal position on the highway, said method being performed by machine and comprising the steps of:

confining the highway markers in a plurality of substantially parallel and substantially linear arrays against movement in one of the two dimensions and the third dimension, while allowing sliding movement along the other of the two dimensions within at least a range of linear length of each array; and rotating all of the arrays as a unit about a generally horizontal axis that is substantially parallel to the other of the two dimensions and generally perpendicular to the third dimension.

18. The method of claim 17, wherein said confining maintains each of the arrays equidistant from immediately adjacent arrays and all of the arrays equidistant from the generally horizontal axis.

19. The method of claim 17, further comprising:

providing a transfer station on the wheeled vehicle adjacent to and aligned with one of the arrays; and sliding an immediately adjacent highway marker between the aligned one of the arrays and the transfer station.

20. The method of claim 19, wherein said providing aligns the transfer station with the one of the arrays so tat the third dimension of the highway markers of the one of the arrays is vertical.

21. A method of exchanging highway markers between storage on a trailer and support on a highway, the trader being under control of a driver of a towing vehicle, said method being performed by machine and comprising the steps of:

transferring a highway marker between a position inboard of the trailer and a position outward of the trailer on a side of the trailer opposite a side where the driver is normally located; recording the environment of the highway adjacent to the position outward of the trailer as a video stream by a camera carried by the trailer;

wirelessly transmitting the video stream in real time to a receiver carried by the tow vehicle; and displaying the video stream on a monitor where the driver is normally located.

22. The method of claim 21, further comprising:

powering the monitor from an outlet located where the driver is normally located.

23. A method of retrieving highway markers from a knocked down horizontal position on a highway and moving it to storage on a vehicle, said method being performed by machine and comprising the steps of:

in response to a control signal generated by the driver, after the driver has maneuvered the vehicle so that a generally horizontal cantilevered member is inserted within a highway marker that is freely supported horizontally on the highway as the vehicle is moved, performing the step of moving the cantilevered member and highway marker thereon to a generally upward orientation;

thereafter generating an upward attraction force on a highway marker substantially greater than a weight of the highway marker, in response to activation;

transferring the highway marker, while the highway marker is held solely by the attraction force, from a position outboard of the vehicle above the highway to a position inboard of the vehicle; and performing said step of transferring so as to move the highway marker from the cantilevered member to the position inboard.

24. The method of claim 23, further comprising:

supporting the terminal end of the cantilevered member at a height above the highway that is independent of the height of the vehicle prior to said step of moving the cantilevered member, to thereby facilitate the insertion of the cantilevered member within the highway marker by the driver's maneuvering.

25. A wheeled trailer for transporting highway markers and for exchanging the highway markers between storage on the trailer and support on a highway, said wheeled trailer comprising:

a main frame;

at least one wheel mounted for rotation on said main frame for engaging the highway and thereby supporting said main frame;

a storage mounted on the main frame and being configured for confining a plurality of the highway markers;

a tow hitch for towing attachment to a tow vehicle;

a transfer mechanism for movement of a pickup end between a first position inboard of said trailer and a second position outward of said trailer above the highway;

a pickup mounted on said pickup end of said transfer mechanism and being capable of holding the highway marker while said transfer mechanism moves said pickup end between said first and second positions;

a video camera positioned to record the environment of the highway adjacent to said pickup end at the second position outward of said trailer as a video; and a wireless transmitter connected to receive and transmit the video stream in real time.

26. A wheeled vehicle for transporting highway markers and for exchanging the highway markers between storage on the vehicle and support on a highway, said wheeled vehicle comprising:

a main frame;

at least one wheel mounted for rotation on said main frame for engaging the highway and thereby supporting said main frame;

an attachment;

a coupling between said attachment and said main frame for temporarily attaching said attachment transversely outboard of said wheeled vehicle;

said attachment having a cantilevered member of a shape to be inserted within a highway marker and a highway engaging member engaging the highway at a location that is generally transversely aligned wit the terminal end of said cantilevered member;

a connection mounting the cantilevered member for movement between a generally forward facing and horizontal position to be inserted within a knocked down highway marker that is freely supported on the highway as the wheeled vehicle is moved forward and a generally vertical position holding an inserted highway marker in a normally upright position; and a connection between said attachment highway engaging member and said cantilevered member fixing elevation of the terminal end of said cantilevered member above the adjacent highway, whereby the terminal end of the cantilevered member is at a height above the highway that is independent of the height of said frame, to thereby facilitate reliable insertion of the, cantilevered member within the highway marker by the driver's maneuvering.

27. The wheeled vehicle of claim 26, further comprising:

a storage mounted on the main frame and being configured for confining a plurality of the highway markers;

a transfer mechanism for movement of a pickup end between a first position inboard of said trailer and a second position outward of said trailer above the highway to pickup the highway marker, when said transfer mechanism is in its second position and said cantilevered member is in the generally vertical position holding an inserted highway marker in a normally upright position; and a pickup mounted on said pickup end of said transfer mechanism and being capable of holding the highway marker while said transfer mechanism moves said pickup end between said first and second positions.

28. The wheeled vehicle of claim 27, wherein:

said attachment highway engaging member is a wheel having a horizontal axis of rotation that is transversely aligned with the terminal end of said cantilevered member when said cantilevered member is in the generally forward facing and horizontal position;

said connection between said attachment highway engaging member and said cantilevered member is a fixed connection; and said connection mounting said cantilevered member for movement is a horizontal axis pivotal connection.

29. The wheeled vehicle of claim 26, wherein:

said attachment highway engaging member is a wheel having a horizontal axis of rotation that is transversely aligned with the terminal end of said cantilevered member when said cantilevered member is in the generally forward facing and horizontal position;

said connection between said attachment highway engaging member and said cantilevered member is a fixed connection; and said connection mounting said cantilevered member for movement is a horizontal axis pivotal connection.

30. The wheeled vehicle of claim 26, wherein:

said attachment further includes two forwardly extending arms that are spaced on respective sides of said cantilevered member;

said connection mounting the cantilevered member including a bearing providing pivotal connection of said cantilevered member relative to said arms at least between said horizontal position and said vertical position;

said arms having at least one support engaging the highway at a location forward of the terminal end of said cantilevered member to support the terminal ends of said arms at a highway elevation that is about one-half the corresponding width of a highway marker and that is independent of both the elevation of said main frame and the elevation of said cantilevered member; and the terminal ends of said arms are spaced apart a distance substantially greater than a corresponding width of the highway markers.

31. The wheeled vehicle of claim 30, further including:

a storage mounted on the main frame and being configured for confining a plurality of the highway markers;

a transfer mechanism for movement of a pickup end between a first position inboard of said trailer and a second position outward of said trailer above the highway to pickup the highway marker, when said transfer mechanism is in its second position and cantilevered member is in the generally vertical position holding an inserted highway marker in a normally upright position;

a pickup mounted on said pickup end of said transfer mechanism and being capable of holding the highway marker while said transfer mechanism moves said pickup end between said first and second positions;

said attachment highway engaging member being a wheel having a horizontal axis of rotation that is transversely aligned with the terminal end of said cantilevered member when said cantilevered member is in the generally forward facing, horizontal position;

said connection between said attachment highway engaging member and said cantilevered member being a fixed connection; and said support for said arms being at least one wheel.

* * * * *